United States Patent [19]

Roth

[11] 4,442,514

[45] Apr. 10, 1984

[54] SECURITY SYSTEM SIGNAL PROCESSOR

[75] Inventor: Roger R. Roth, Minnetonka, Minn.

[73] Assignee: The United States of America as represented by the Secretary of the Air Force, Washington, D.C.

[21] Appl. No.: 329,560

[22] Filed: Nov. 17, 1981

[51] Int. Cl.[3] ..... G08B 13/00

[52] U.S. Cl. ..... 367/136; 340/566

[58] Field of Search ..... 367/136; 340/566

[56] References Cited

U.S. PATENT DOCUMENTS

| | | | |
|---|---|---|---|
| 3,727,206 | 4/1973 | Geil et al. | 340/258 R |
| 3,774,190 | 11/1973 | Kyle | 340/258 R |
| 3,824,532 | 7/1974 | Vandierendonck | 367/136 |
| 3,913,085 | 10/1975 | Farstad | 367/136 |

*Primary Examiner*—Richard A. Farley

*Attorney, Agent, or Firm*—Donald J. Singer; Willard R. Matthews

[57] ABSTRACT

Alarm and intrusion type identification signals are derived from the output of a security system transducer by a signal processor. The signal processor conditions the transducer output signals to provide rectified and unrectified high pass and low pass frequency signals; develops signals representing either human or vehicle intrusions from the high pass frequency signals; develops signals representing intrusion events from the low pass frequency signals; and, logically classifies each intrusion event as either human or vehicle. Intrusion type identification signals are developed by counting zero crossings of the unrectified high pass frequency signal, measuring current energy of the rectified high pass frequency signal and logically comparing the two values. Intrusion event signals are developed by generating zero crossing windows for the unrectified low pass frequency signal, measuring energy of the rectified low pass frequency signal and comparing energy values with a threshold determined by the number of zero crossing windows having two or more zero crossing.

7 Claims, 4 Drawing Figures

FIG. 3
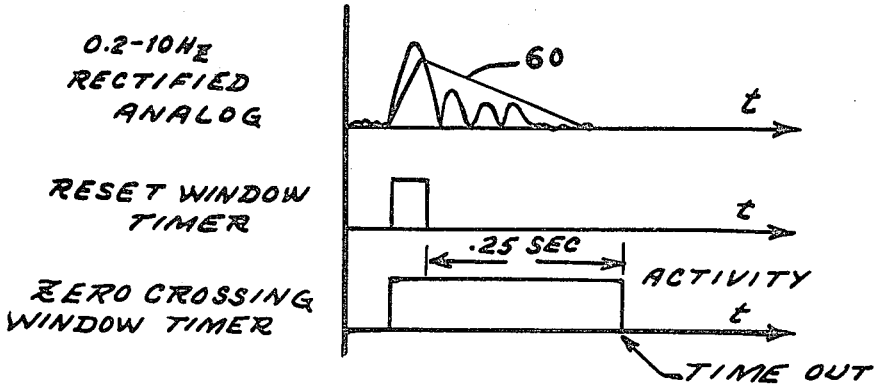
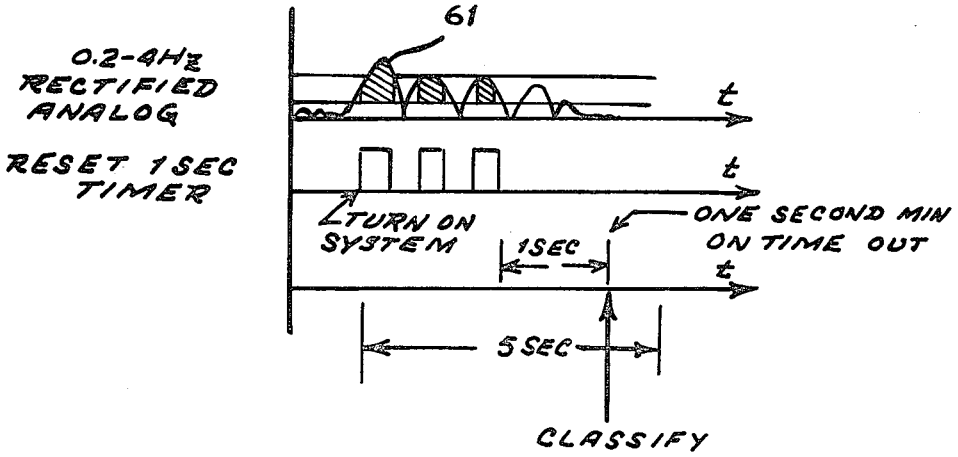
FIG. 4

SECURITY SYSTEM SIGNAL PROCESSOR

STATEMENT OF GOVERNMENT INTEREST

The invention described herein may be manufactured and used by or for the Government for governmental purposes without the payment of any royalty thereon.

BACKGROUND OF THE INVENTION

This invention relates to security systems that automatically detect and indicate intrusions into a protected area. It relates particularly to a signal processor for such a system that is capable of distinguishing between human and vehicular intrusions.

Security systems of the type to which this invention pertains are commonly used to protect important areas such as airports and other strategic locations from intrusions by unorthorized persons and vehicles. Such systems employ sensor (transducing) elements that encompass the area to be protected. Various types of sensor elements and detecting schemes are used. All, however, develop a signal in response to an intrusion event. The signal is used for alarm and surveillance purposes.

Although systems of this type are generally effective they are subject to some limitations and deficiencies that state-of-the-art technology has yet to overcome. Specifically, it would be desirable in many instances to be able to distinguish between a human intrusion and a vehicular intrusion. For instance, if one type of intrusion was permitted and the other was not. Security systems currently in use normally cannot reliably distinguish between various classes of intruders.

Another problem encountered with state-of-the-art security systems is the occurrances of false alarms due to wind and other non-relevant transducer actuating events. Also inefficient transducer operation is often encountered under adverse environmental conditions such as frozen ground and the like.

Accordingly, there currently exists the need for signal processing equipment that can provide reliable, unambiguous information from conventional security system transducer outputs and that overcomes the above noted deficiencies and limitations of known security systems.

The present invention is directed toward satisfying that need.

SUMMARY OF THE INVENTION

A signal processor provides an alarm and separate indication in response to security system intrusions caused by either humans or vehicles. Signals from the security system transducer are processed to provide suitable voltage levels for two channels of information. One channel carries high pass frequency signals (0.2 to 10 hz) and the other carries low pass frequency signals (0.2 to 4 hz). Intruder identification is accomplished by a circuit that counts zero crossings of the signal and measures current energy in the high pass frequency channel and logically combines the results. When energy values exceed zero crossing frequency values by a given amount, intrusions are classified as vehicles, otherwise as humans. Intrusion event detection is implemented by a circuit that generates zero crossing windows in the low pass frequency channel and compares energy values in that channel with a threshold generated by the number of zero crossing windows having two or more zero crossings. When the energy value exceeds the threshold an alarm is generated. AND gates combine identification circuit outputs with intrusion event detection circuit outputs to signal and identify intrusions and their types. Other circuit features prevent false alarms and erroneous identifications due to wind and non-relevent isolated events such as lightning.

It is a principal object of the invention to provide a new and improved security system signal processor.

It is another object of the invention to provide a security system signal processor that can reliably distinguish between and develop signals that indicate intrusions by human and vehicular intruders.

It is another object of the invention to provide a security system signal processor that eleminates false alarms due to wind and lightning actuated intrusion detectors.

It is another object of the invention to provide a security system signal processer that allows system operations under adverse environmental conditions.

These together with other objects, features and advantages of the invention will become more readily apparent from the following detailed description, taken in conjunction with the illustrative embodiment in the accompanying drawing.

DESCRIPTION OF THE DRAWINGS

FIG. 3 is a graph showing typical zero crossing window timer waveforms generated in the detection logic of FIG. 2; and FIG. 4 is a graph showing typical on-off timing waveform generated in the detection logic of FIG. 2.

DETAILED DESCRIPTION OF THE PREFERRED EMBODIMENT

The Signal Processor of the invention is an electronic device which processes signals from a security system transducer, and provides alarms when signals are caused by humans or vehicles crossing the transducer. Separate indications are provided for vehicles and for humans.

This invention is unique in the way in which it derives and processes information from the input signal, so as to reliably separate and indicate humans and vehicles, and in its ability to reject wind noise without indicating incorrect alarms. It also has a unique ability to perform these functions when the transducer is emplaced in both frozen and unfrozen ground.

In operation, the input signal is processed by an amplifier, and by filters which produce suitable voltage levels for two channels of information. One channel includes signals from 0.2–4 Hz; the other, signals from 0.2–10 Hz.

Certain "features" are extracted from these information channels. Decisions as to human, vehicle, or no intrusion are based on the relationships of these features, when a transducer signal is present. These features include: (a) a low frequency energy above a threshold that improves the separation of humans and wind by making the threshold vary with the wind noise; (b) an on-off system that allows multiple decisions for threshold crossing; (c) a frequency feature that is a measure of the average frequency based on the number of zero crossings and assists in the separation of humans and vehicles; (d) an energy feature that determines average energy in a selected bandpass and designates vehicles as producing more energy; (e) long term average energy for use in concert with other features to reduce false alarms due to increases in background noise; and (f) a feature that determines the number of zero crossing windows containing two or more zero crossings in order to separate lightning from actual intrusions.

The signal processor of the invention comprises: a signal conditioning circuit that receives the security system transducer output signals and develops rectified and unrectified high pass frequency signals; an intrusion type identification circuit that develops signals representing human intrusion and signals representing vehicle intrusion from the rectified and unrectified high pass frequency signals; an intrusion event detection circuit that develops intrusion event signals from the rectified and unrectified low pass frequency signals; and a classification logic circuit working in concert with the other circuits that provides output signals in response to human intrusion events and vehicle intrusion events.

Figure 1:
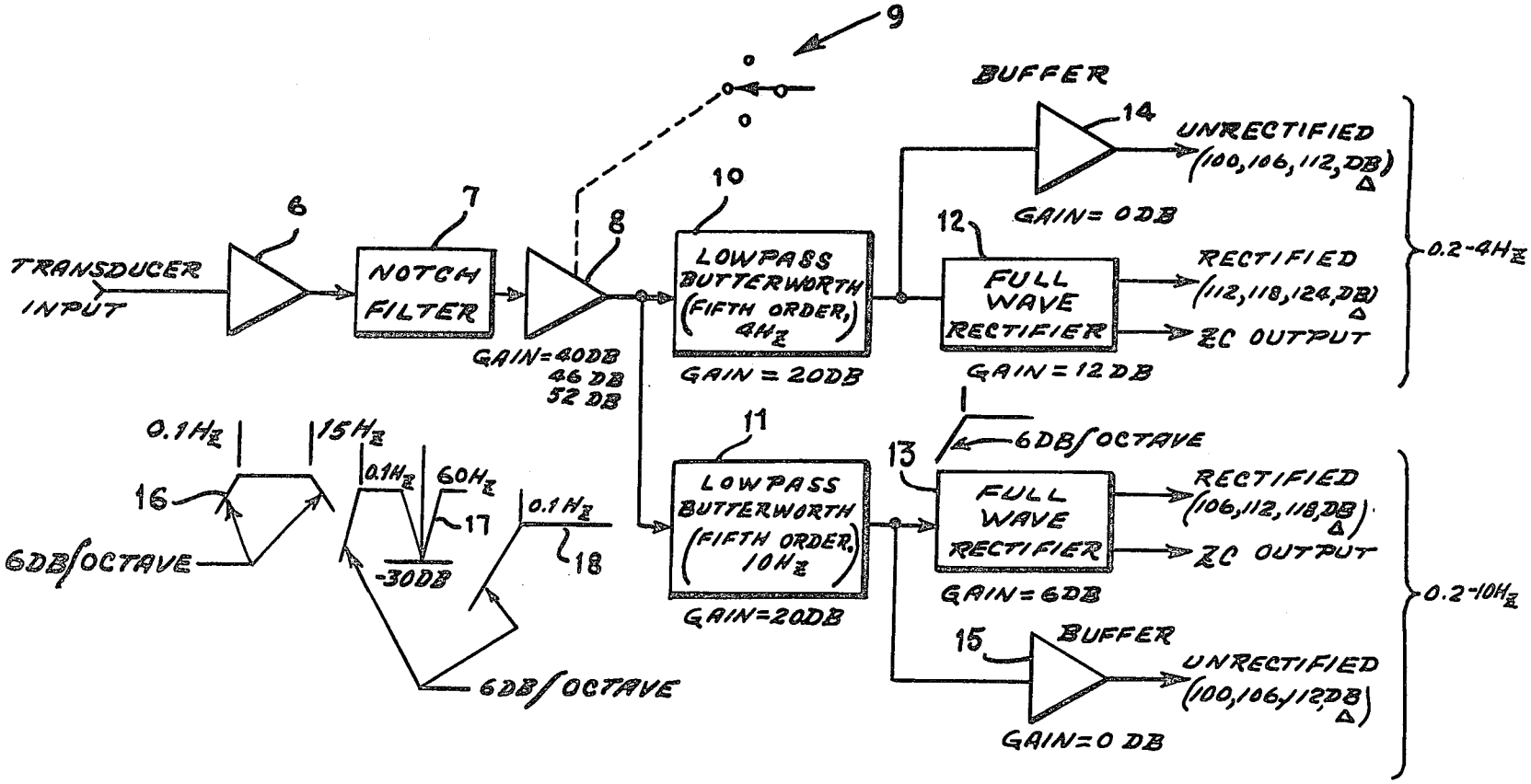
FIG. 1 is a block diagram of the signal conditioning circuit of the signal processor of the invention.

The signal conditioning circuit is shown in block diagram form by FIG. 1 and comprises preamplifier 6, notch filter 7, post amplifier 8 having a gain switch 9, low pass filters 10 and 11, full wave rectifiers 12 and 13, and buffer amplifiers 14 and 15.

Figure 2:
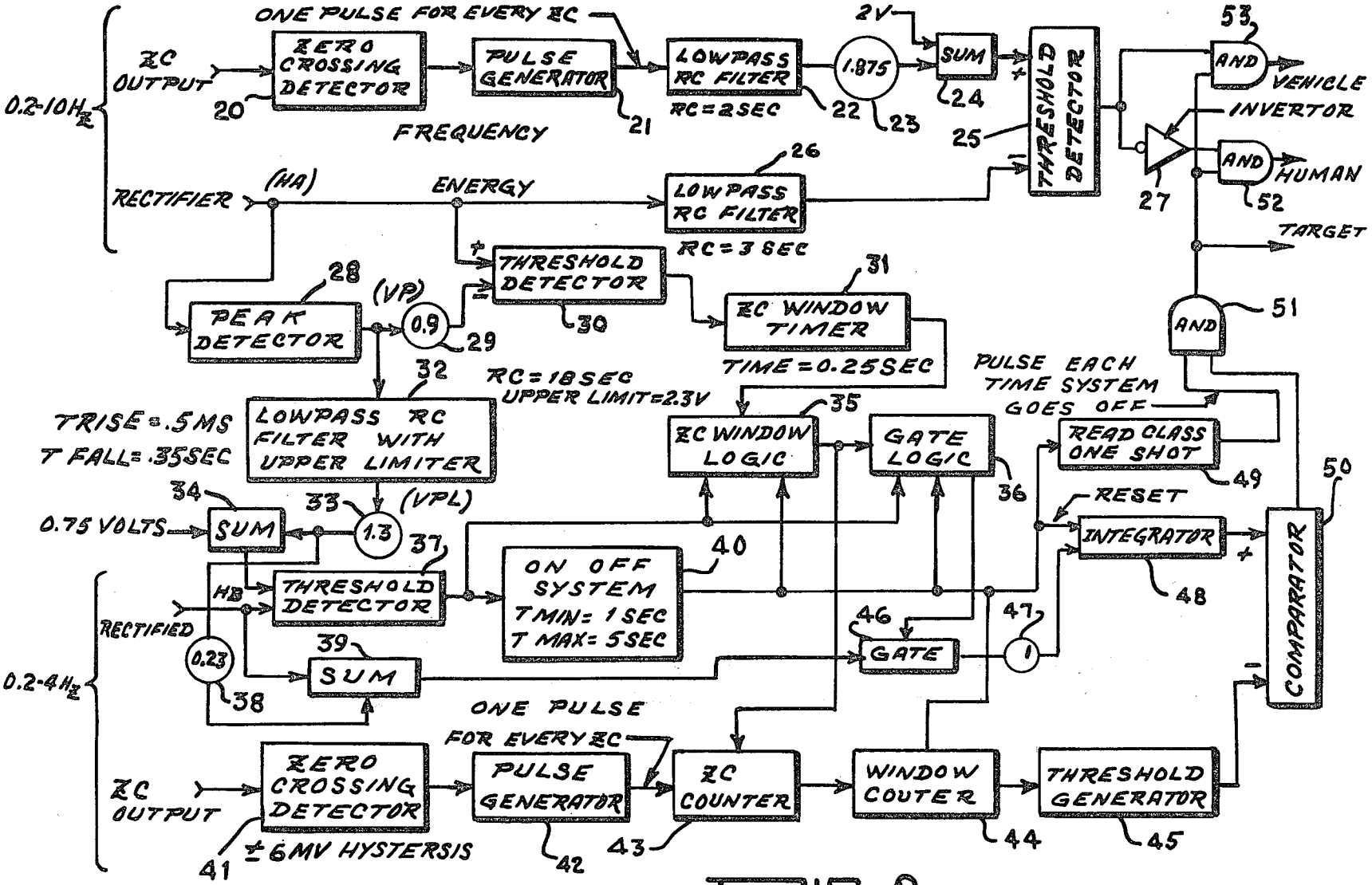
FIG. 2 is a block diagram of the classification and detection logic of the signal processor of the invention.

The intrusion type identification circuit is shown in FIG. 2 and comprises zero crossing detector 20, pulse generator 21, low pass filter 22, gain function means 23, summing means 24, low pass RC filter 26, threshold detector 25 and inverter 27.

FIG. 2 also shows the intrusion event detection circuit which comprises threshold detectors 30 and 37, gain function means 29, 33, 38 and 47, peak detector 28, zero crossing window timer 31, low pass RC filter 32, summing means 34, 39 zero crossing window logic 35, gate logic 36, on-off system 40, zero crossing detector 41, pulse generator 42, zero crossing counter 43, window counter 44, threshold generator 45, gate 46, integrator 48, one shot multivibrator 49, comparator 50 and AND gate 51.

The classification logic circuit consists of AND gates 52, 53.

Gain function means 23, 29, 33, 38 and 47 may be any appropriate means for achieving the designated gain and all other components of the circuits described are conventional off the shelf items and are adapted to the functions indicated in accordance with standard engineering practice.

By way of operating example zero crossing window timer 31 resets when voltage HA is greater than 0.9 VP. When not reset the timer clocks until time reaches the 0.25 second timeout condition. The normal state of on-off system 40 with no signal is off. When voltage HB is greater than 1.3 VPL+0.75 volt on-off system 40 turns on. The minimum on the timer in on-off system 40 is reset when voltage HB is greater than 1.3 VPL+0.75 and times when not being reset. When the minimum on the timer in on-off system 40 times out (1 second after the last time voltage HB is greater than 1.3 VPL+0.75) or when the maximum on the timer times out (5 seconds after the system turned on) the system on/off goes to the off state. The system stays off approximately 2 ms before it can be turned on again. The zero crossing window logic 35 generates the zero crossing window only when the system is on. The window starts when zero crossing window timer 31 has not timed out and voltage HB is greater than 1.3 PL+0.75. The window ends when zero crossing window timer 31 times out.

Zero crossing counter 43 counts the number of zero crossings on the 0.2 to 4 Hz channel during a zero crossing window; otherwise it is reset to zero. Gate logic 36 opens gate 46 for integrator 48 during the zero crossing window and voltage HB is greater than 1.3 VPL+0.75. The system must be on to open the gate 46. Integrator 48 integrates HB-0.3 VPL/0.66 sec when gate 46 is open and is reset to zero when the system is off. Window counter 44 counts the number of zero crossing windows that have two or more zero crossings. When the integrater output voltage exceeds a threshold a target class (human or vehicle) is indicated when the system goes off. The threshold is set in accordance with Table I.

TABLE I

| No of ZC Windows having two or more ZC | Threshold |
|---|---|
| 0 | infinity |
| 1 | 4.0 |
| 3 or more | 2.0 |

If the energy exceeds 2+1.875 frequency then the vehicle class is indicated when detection of a target occurs; otherwise a human intrusion is indicated.

Referring now to FIG. 1 the output from the security system transducer is first amplified and filtered somewhat by preamplifier 6. Output from preamplifier 6 is passed through twin T 60 hz notch filter 7. The post amplifier 8 has a three position gain switch 9 for adapting the signal processor gain for various site conditions. The bandpass characteristics of pre-amplifier 6, notch filter 7 and post amplifier 8 are shown by waveforms 16, 17 and 18 respectively. Post amplifier 8 output is further amplified and filtered by two low pass fifth order Butterworth filters 10, 11. Filter 10 has a break frequency of 4 hz and filter 11 has a break frequency of 10 hz. Outputs from the filters are fullwave rectified by rectifiers 12, 13 for use by logic circuits hereinafter described. In addition, buffer stages (amplifiers 14, 15) allow unrectified analog signals to be recorded during field testing. The gain of the two channels are not the same and the buffer outputs have less gain than the full wave-rectified channels.

The classification and detection logic is block diagrammed in FIG. 2 and has been described above. Referring thereto the frequency feature (a function of the intrusion type identification circuit) first detects zero crossing from the 0.2 to 10-Hz channels and generates a 6-volt pulse for every zero crossing. The pulses are then filtered by lowpass RC filter 22. The frequency feature is then a voltage that is low for low frequencies and higher for higher frequencies. The frequency feature is averaged by the RC filter 22 and is extracted continuously, independent of the turn-on/off system.

The energy feature (also a function of the intrusion type identification circuit) is extracted from the rectified analog, 0.2- to 10-Hz channel, by lowpass RC filter 26. The energy is a measure of the energy in the 0.2- to 10-Hz passband over the last few seconds. Energy is also extracted continuously independent of the turn-on/off system.

The energy and frequency features ae combined in decision logic including threshold circuit 25 and inverter 27 to classify any detected targets as human or vehicle. When the energy feature exceeds 1.875 times the frequency feature voltage plus 2 volts, any detected targets are classified as vehicle. If this criteria is not met, the target is classified as a human. This decision logic is active continuously but the decision is only polled when the detection logic detects a target. Generally, when the frequency is low and the amplitude is high in the 0.2- to 10-Hz channel, the target is classified as a vehicle. When the amplitude is low it is classified as a human.

Zero crossing (ZC) window timing (FIG. 3) is generated by first peak detecting the rectified analog from the 0.2- to 10-Hz channel. When the rectified analog exceeds 0.9 of the peak detector output (VP) as shown by curve 60, the ZC window timer is reset. As soon as the rectified analog is less than 0.9 VP, the timer starts to run and times out in 0.25 seconds. This output indicates when there is activity in the 0.2- to 10-Hz channel and is used to generate ZC windows. Human and vehicle targets have activity in the 0.2- to 10-Hz channel, and lightning generally has one activity per lightning event.

Referring to FIGS. 2 and 4, a threshold determined by the background noise is generated by lowpass filtering the peak detected 0.2- to 10-Hz rectified analog by a long time constant. This voltage (VPL), intended to represent the background noise, is used as a threshold for on/off system 40, is used by the low-frequency energy feature identification circuit, and is used to determine when a ZC window is started. When the 0.2- to 4-Hz rectified analog exceeds 1.3 VPL+0.75 volt as indicated by curve 61 of FIG. 4 the system is turned on, and the 1-second minimum timer is reset to zero. If the 1-second timer times for 1 second without being reset, the system goes off. When the 1-second timer does not cause turn-off, the system goes off when 5 seconds has elapsed since turn-on. FIG. 4 illustrates the case where the 1-second timer times out before the 5-second timer. The features are classified at the turn-off time.

Zero-crossing windows are generated when the system is on. A zero-crossing window starts when the ZC timer 31 shows activity on the 0.2- to 10-Hz channel and the 0.2- to 4-Hz rectified analog exceeds the threshold. The ZC window is used to gate (turn on and off) the input to the low-frequency integrator. When a ZC window is generated and the rectified analog exceeds the threshold (1.3 VPL+0.75), and the system is on, the integrator integrates the voltage HV-0.3 VPL. Effectively, the area integrated depends on: (a) the level of the 0.2- to 4-Hz rectified analog; (b) the activity on the 0.2- to 10-Hz channel occurring at the same time the 0.2- to 4-Hz level exceeds the threshold (1.3 VPL+0.75); (c) the background noise (more background noise causes less voltage integrated); and, (d) the amount of time system is on.

The integrator is reset after classification.

Targets crossing the line tend to have more energy integrated as low frequency energy. High background levels tend to reduce the energy integrated.

The zero crossings in the 0.2- to 4-Hz channel are detected and counted as another feature used for detection. Zero crossings are counted when zero-crossing windows are generated. In addition, the number of windows having two or more zero crossings is counted by another counter 43. The number of zero-crossing windows containing two or more zero crossings is counted starting when the system turns on and resets after classification at turn-off time. Targets crossing the transducer have at least one window with two or more zero crossings, while lightning usually has only one window with less than two zero crossings per window.

The detection logic is implemented by comparing the low-frequency energy integrated by the integrator and a threshold generated by the number of zero-crossing windows having two or more zero crossings. Table I illustrates the threshold voltages used. When the low-frequency energy exceeds this threshold (at the time to classify), an alarm is generated. When no zero-crossing windows contain a zero crossing, it is impossible to get an alarm with this logic. When alarms are generated, they are further classified as human or vehicle by the classifier logic previously described.

While the invention has been described in one presently preferred embodiment, it is understood that the words which have been used are words of description rather than words of limitation and that changes within the purview of the appended claims may be made without departing from the scope and spirit of the invention in its broader aspects.

What is claimed is:

1. In combination with a security system having transducer means responsive to intrusion event detection, a signal processor comprising:

a signal conditioning circuit receiving transducer means output signals and developing therefrom rectified and unrectified high pass frequency signals and rectified and unrectified low pass frequency signals, an intrusion type identification circuit receiving said rectified and unrectified high pass frequency signals and developing therefrom signals representing human intrusions and signals representing vehicle intrusions, an intrusion event detection circuit receiving said rectified and unrectified low pass frequency signals and said rectified high pass frequency signal and developing therefrom discrete intrusion event signals, and a classification logic circuit receiving said intrusion event signals, said signals representing human intrusions and said signals representing vehicle intrusions and providing output signals in response to human intrusion events and output signals in response to vehicle intrusion events.

2. A signal processor as defined in claim 1 wherein said signal conditioning circuit comprises:

a first filter means having a given upper frequency limit and outputting high pass frequency signals, said first filter means receiving transducer means output signals, a first rectifier means connected to rectify the output of said first fiter means, a second filter means having an upper frequency limit less than the upper frequency limit of said first filter means and outputting low pass frequency signals, said second filter means receiving transducer means output signals, and a second rectifier means connected to rectify the output of said second filter means.

3. A signal processor as defined in claim 2 wherein said intrusion type identification circuit comprises:

a first zero crossing detector receiving unrectified high pass frequency signals, a first pulse generator receiving the output of said first zero crossing detector, a first low pass RC filter receiving the output of said first pulse generator, a first summing means summing the output of said first low pass RC filter and a first reference voltage, a second low pass RC filter receiving rectified high pass frequency signals, a first threshold detector receiving the outputs of said first summing means and said second low pass RC filter, and an inverter receiving the output of said first threshold detector.

4. A signal processor as defined in claim 2 wherein said intrusion event detection circuit comprises:

a peak detector receiving said rectified high pass frequency signal, a second threshold detector receiving said rectified high pass frequency signal and the output of said peak detector, a zero crossing window timer receiving the output of said threshold detector, a third low pass RC filter receiving the output of said peak detector, a second summing means summing the output of said third low pass RC filter and a second reference voltage, a third threshold detector receiving the output of said second summing means and said rectified low pass frequency signal, a third summing means receiving the output of said third low pass RC filter and said rectified low pass frequency signal, an on-off circuit receiving the output of said third threshold detector, a zero crossing window logic circuit receiving the output of said zero crossing window timer, said third threshold detector and said on-off circuit, a gate logic circuit receiving outputs of said zero crossing logic circuit, said third threshold detector and said on-off circuit, a gate means receiving the outputs of said third summing means and said gate logic circuit, a second zero crossing detector receiving said unrectified low pass frequency signal, a second pulse generator receiving the output of said second zero crossing detector, a zero crossing counter receiving the outputs of said second pulse generator and said second zero crossing window logic circuit, a window counter receiving the outputs of said zero crossing counter and said on-off circuit, a threshold generator receiving the output of said window counter, integrator means receiving the outputs of said gate means and said on-off circuit, a one shot multivibrator receiving the output of said on-off circuit, comparator means receiving the outputs of said threshold generator and said integrator means, and a first AND gate receiving the outputs of said one shot multivibrator and said compartor means.

5. A signal processor as defined in claim 3 wherein said intrusion event detection circuit comprises:

a peak detector receiving said rectified high pass frequency signal, a second threshold detector receiving said rectified high pass frequency signal and the output of said peak detector, a zero crossing window timer receiving the output of said threshold detector, a third low pass RC filter receiving the output of said peak detector, a second summing means summing the output of said third low pass RC filter and a second reference voltage, a third threshold detector receiving the output of said second summing means and said rectified low pass frequency signal, a third summing means receiving the outputs of said third low pass RC filter and said rectified low pass frequency signal, an on-off circuit receiving the output of said third threshold detector, a zero crossing window logic circuit receiving the outputs of said zero crossing window timer, said third threshold detector and said on-off circuit, a gate logic circuit receiving outputs of said zero crossing logic circuit, said third threshold detector and said on-off circuit, a gate means receiving the outputs of said third summing means and said gate logic circuit, a second zero crossing detector receiving said unrectified low pass frequency signal a second pulse generator receiving the output of said second zero crossing detector, a zero crossing counter receiving the outputs of said second pulse generator and said second zero crossing window logic circuit, a window counter receiving the outputs of said zero crossing counter and said on-off circuit, a threshold generator receiving the output of said window counter, integrator means receiving the output of said gate means and said on-off circuit, a one shot multivibrator receiving the output of said on-off circuit, comparator means receiving the outputs of said threshold generator and said integrator means, and a first AND gate receiving the output of said one shot multivibrator and said comparator means.

6. A signal processor as defined in claim 5 wherein said classification logic circuit comprises:

an inverter receiving the output of said first threshold detector, a second AND gate receiving the output of said first threshold detector and said first AND gate and outputting signals responsive to vehicle intrusion events, and a third AND gate receiving the outputs of said inverter and said first AND gate and outputting signals responsive to human intrusion events.

7. A signal processor as defined in claim 6 wherein said first filter means has an upper frequency limit of approximately 10 hz and said second filter means has an upper frequency limit of approximately 4 hz.

* * * * *